US006474527B2

(12) United States Patent
Miller

(10) Patent No.: US 6,474,527 B2
(45) Date of Patent: Nov. 5, 2002

(54) MULTIPLE-PITCH TAPE FEEDER WITH MULTIPLE PEEL POSITIONS

(75) Inventor: James G. Miller, Hilton, NY (US)

(73) Assignee: Hover-Davis, Inc., Rochester, NY (US)

( * ) Notice: Subject to any disclaimer, the term of this patent is extended or adjusted under 35 U.S.C. 154(b) by 12 days.

(21) Appl. No.: 09/736,772

(22) Filed: Dec. 14, 2000

(65) Prior Publication Data

US 2002/0108984 A1 Aug. 15, 2002

(51) Int. Cl.[7] ..... B65H 23/18; B65H 20/36

(52) U.S. Cl. ..... 226/32; 226/128; 226/133; 226/139

(58) Field of Search ..... 226/128, 133, 226/139, 32

(56) References Cited

U.S. PATENT DOCUMENTS

| | | | | |
|---|---|---|---|---|
| 2,095,125 A | * | 10/1937 | Cornock | 226/32 |
| 3,281,037 A | * | 10/1966 | Young | 226/139 X |
| 4,327,482 A | | 5/1982 | Araki et al. | |
| 5,191,693 A | * | 3/1993 | Umetsu | 29/429 |
| 5,294,035 A | | 3/1994 | Asai et al. | |
| 5,299,902 A | * | 4/1994 | Fujiwara et al. | 414/416.01 |
| 5,531,859 A | | 7/1996 | Lee et al. | |
| 5,588,614 A | * | 12/1996 | Takada et al. | 226/139 X |
| 5,725,140 A | | 3/1998 | Weber et al. | |
| 6,032,845 A | | 3/2000 | Piccone et al. | |
| 6,162,007 A | * | 12/2000 | Witte | 414/416.01 |
| 6,199,738 B1 | * | 3/2001 | Kondo et al. | 226/118 X |

FOREIGN PATENT DOCUMENTS

EP 0236225 A2 9/1987

* cited by examiner

*Primary Examiner*—Michael R. Mansen
*Assistant Examiner*—Minh-Chau Pham
(74) *Attorney, Agent, or Firm*—Greenwald & Basch LLP; Duane C. Basch

(57) ABSTRACT

The present invention is an apparatus for multiple-pitch carrier tape feeding, including a carrier tape reel support, a slidable tape window and cover tape peel edge for exposing a component at a pick location adjacent a peel edge, and a carrier tape drive mechanism for advancing the carrier tape through the tape guide. The feeder also includes a pitch selection cam having a plurality of positions, each corresponding to one of a plurality of carrier tape pitch sizes, wherein movement of said selection cam is directly translated into movement of the tape guide. A sensor is employed for detecting the position of the selection cam, and a control unit, responsive to the sensor, controls the carrier tape drive, thereby advancing the carrier tape a predetermined distance according to the selected pitch size.

9 Claims, 10 Drawing Sheets

MULTIPLE-PITCH TAPE FEEDER WITH MULTIPLE PEEL POSITIONS

CROSS REFERENCE

The following related application is hereby incorporated by reference for its teachings:

"TAPE FEEDER WITH SPLICING CAPABILITIES," James G. Miller et al., application Ser. No. 09/736,823, filed concurrently herewith.

The following related patent is hereby incorporated by reference for its teachings "Variable Pitch Tape Feeder and Pitch Selection" Piccone et al., U.S. Pat. No. 6,032,845.

This invention, relates generally to the assembly of printed circuit board assemblies (PCBAs) and electronic components, and more particularly to a multiple pitch tape feeder device for reliably conveying parts to a pickup location for soldering to a substrate using a pick and place assembly machine.

BACKGROUND AND SUMMARY OF THE INVENTION

The present invention is a multiple pitch tape feeder device for reliably conveying parts to a pickup location for soldering or other attachment to a substrate using a pick and place assembly machine. Component carrier tape used in tape feeding equipment typically comprise a plastic or similar strip having depressions or pockets at regular intervals containing the part to be mounted on the substrate and a second, flat (e.g., Mylar) cover strip covering the depressions to retain the parts in the depressions during transport and use. This invention relates to a tape feeder device which can feed such carrier tapes in a variety of formats, including tapes which vary in pitch, i.e., different, predefined distances from one depression to the next on the tape. Most particularly, this invention relates to a variable pitch tape feeder device that is versatile and easy to operate as a result of a number of improvements incorporated therewith.

The preferred method for the automated construction of circuit boards requires the use of high speed pick and place assembly machines that pick components from a pickup location and place them at required locations on a printed circuit board for attachment. Pick and place machines rely on feeding mechanisms to reliably present the required parts to the expected pickup location. It is well-known in the industry to package small electronic parts such as integrated circuit chips in a carrier tape that is characterized by a flexible strip with depressions formed at regular intervals along its length. A part is disposed in each depression and secured by a cover strip that is adhered along its edges to the carrier tape by either a heat-sealing method or pressure sensitive adhesive. Parts that are packaged in a carrier tape require the cover strip be peeled away from the carrier tape and that the carrier tape be advanced to bring the next part to the pickup location. Normally, the carrier tape is peeled back from the carrier tape at a point just prior to the pick location as the tape is advanced in order to retain the component part in its respective pocket.

Electronic parts are packaged in carder tapes in a variety of formats, depending on the size of the part being delivered. In particular, carrier tapes are available in varying widths and pitches. The width is the distance from edge to edge perpendicular to the length of the tape. Widths common in the industry are 8 mm, 12 mm, 16 mm, 24 mm and larger. The pitch of a carrier tape is the distance from one depression (e g. lead edge) to the next (lead edge) along the length of the tape. An aspect of the present invention is directed to a tape feeder capable of delivering parts on 8 and 12 mm width tapes, though it can be easily modified to accommodate other sizes. The most popular pitches used by electronic parts manufacturers with 8 and 12 mm wide tapes are 2 mm, 4 mm, and 8 mm and 12 mm. Tapes are wound on reels and transported to the manufacturing facility. It is obvious that the part manufacturer and user will desire to use the smallest pitch tape permissible for the size of the electronic component in order to control the three-dimensional orientation of the component.

For applications requiring high speed operation using low mass components, particularly those components with pitches of 8 mm or less, it is also important to provide means to keep each part from escaping its respective recess after the cover tape strip is removed, but before it reaches the pick location. To this end, shutters have been employed to cover the carrier tape past the point where the cover strip is peeled away up to the pick location.

An example of a variable-pitch feeder is found in U.S. Pat. No. 6,032,845 for a VARIABLE PITCH TAPE FEEDER AND PITCH SELECTION SWITCH THEREFOR by Piccone et al., assigned to Hover-Davis, Inc. and hereby incorporated by reference for its teachings. A further example of a feeder is the fixed-pitch feeder shown in U.S. Pat. No. 4,327,482, where carrier tape is supplied and the cover strip is removed and is taken up by cover strip take-up reel as the carrier tape is advanced.

Tapes of varying widths are accommodated via a feeder dedicated to said specific width, whereas a variety of pitches can be accommodated by a single feeders providing a multiple-pitch feeder requires that the amount of carrier tape advance must be selectable, and the pickup location must be adjustable to assure that the component is exposed and located at the centroid of the pick location.

Heretofore, a number of patents and publications have disclosed a variable pitch tape feeder that can both vary the advance of the carrier tape and the travel distance of the shutter mechanism, the relevant portions of which may be briefly summarized as follows.

U.S. Pat. No. 5,725,140 to Weber et al. describes a variable pitch tape feeder. The feeder includes adjustment means for varying the advance of the carrier tape to accommodate tapes of varying pitch as well as an adjustment for the travel distance of the shutter mechanism.

U.S. Pat. No. 5,531,859 to Lee et al. and U.S. Pat. No. 5,294,035 to Asai et al. do not employ shutters, but enable selection of pitch advancement of a carrier tape by adjusting a pivot point in a manner similar to U.S. Pat. No. 5,725,140. For example, in U.S. Pat. No. 5,294,035, a lever is provided with a several pivot points, each one of which provides for a different travel distance of a plate which ultimately drives a feed pawl. Again, no shutter mechanism is provided and a large rectangular opening does not prevent exposed parts from escaping from their depressions.

In accordance with the present invention, there is provided a multiple-pitch tape feeder, comprising: a carrier tape reel support for supporting carrier tape having any one of several predetermined pitches and a cover tape retaining components therein; a slidable tape guide with a tape window for exposing a component at a pick location adjacent a peel edge for peeling said cover tape from the carrier tape; a path for guiding said carrier tape from a carrier tape reel to the slidable tape guide; a carrier tape drive mechanism for engaging feed-holes regularly spaced along the length of carrier tape and advancing said carrier tape through said tape guide; a pitch selection cam repositionable by an operator, said selection cam having a plurality of positions, each corresponding to one of a plurality of predetermined pitch sizes, wherein movement of said selection cam is directly translated into movement of said slidable tape guide; a sensor detecting the position of the slidable tape guide; and a control unit, responsive to said sensor, for providing a signal to said carrier tape drive means, said carrier tape drive means advancing the carrier tape a predetermined distance according to the pitch size.

The techniques described above are advantageous because they are flexible and one or more of the techniques can be adapted to any of a number of tape feeding systems. The techniques of the invention are advantageous because they provide a range of alternatives, each of which is useful in appropriate situations, that enable a single feeder to be used in an environment where multiple pitch carrier tapes are frequently used—thereby increasing the usefulness of the feeder. In addition, some of the techniques described herein can be used separately in certain situations so as to achieve similar functionality. As a result of the inventions described herein, tape feeders with improved flexibility and functionality may be produced.

Figure 1:
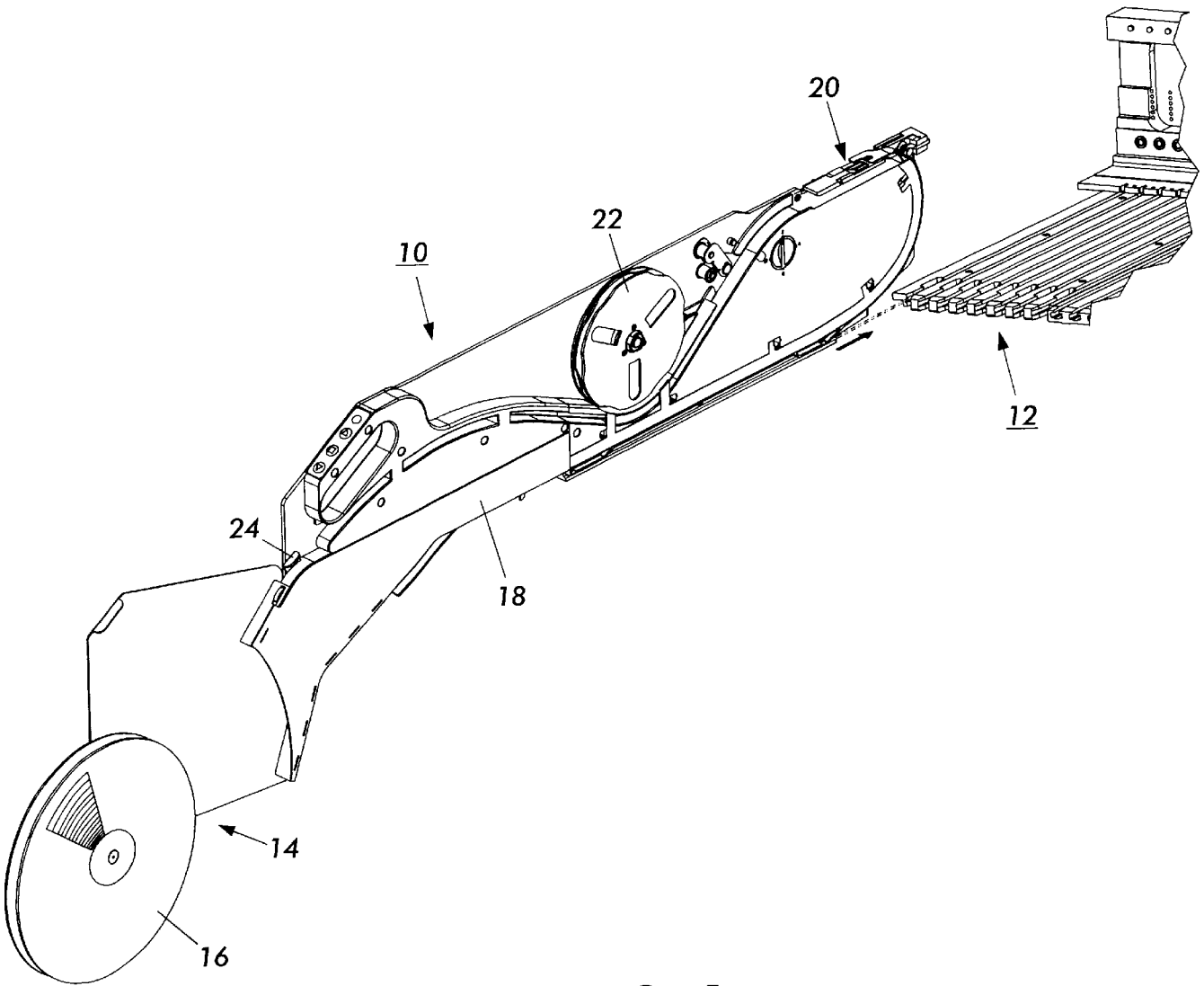
FIG. 1 is a general perspective view of an embodiment of the present invention in association with an interface for a pick and place system.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description.

"Component" is used to represent any of a number of various elements that may be automatically retrieved and applied to a printed circuit board assembly (PCBA). "Carrier tape" is intended to represent a component feeding tape having at least a component tape or base layer with punched or embedded pockets in which the components are carried, and a cover tape layer thereover to retain the components within the pockets during transport and use of the tape. Carrier tapes come in various widths, depending upon component size and are typically in the range of 8 to 56 mm. The parallel edges of the cover tape are affixed to the carrier layer using an adhesive or thermal process so the cover tape generally remains attached to the carrier layer when the component carrier tape is wound on a reel for ease of transportation and use. As noted above, the carrier tapes also come in multiple pitches.

Turning now to the drawings, FIG. 1 is a perspective illustration of a multi-pitch feeder 10 being inserted into a receiving interface 12 of a pick and place assembly system (not shown). As will be appreciated by those familiar with tape feeders and assembly systems, it is common to utilize a plurality of tape feeders positioned adjacent one another in the receiving interface so as to permit the feeding and assembly of a plurality of components onto the printed circuit boards. It will be further appreciated that any opportunity to reduce the number of feeders required will further reduce the overall cost of operating such a system.

Feeder 10 preferably includes a carrier tape support 14 supporting a carrier tape reel 16. Tape from reel 16 is fed through a tape path in the body 18 of the feeder. Ultimately, the carrier tape is fed through a tape window at pick location 20, where the cover tape is peeled away and the carrier tape is advanced so that components may be removed therefrom. The cover tape is then wound about take-up reel 22. As further illustrated in FIG. 1, the feeder includes a latch 24 that allows the feeder to be unlocked from the receiving interface when necessary for removal.

Figure 2:
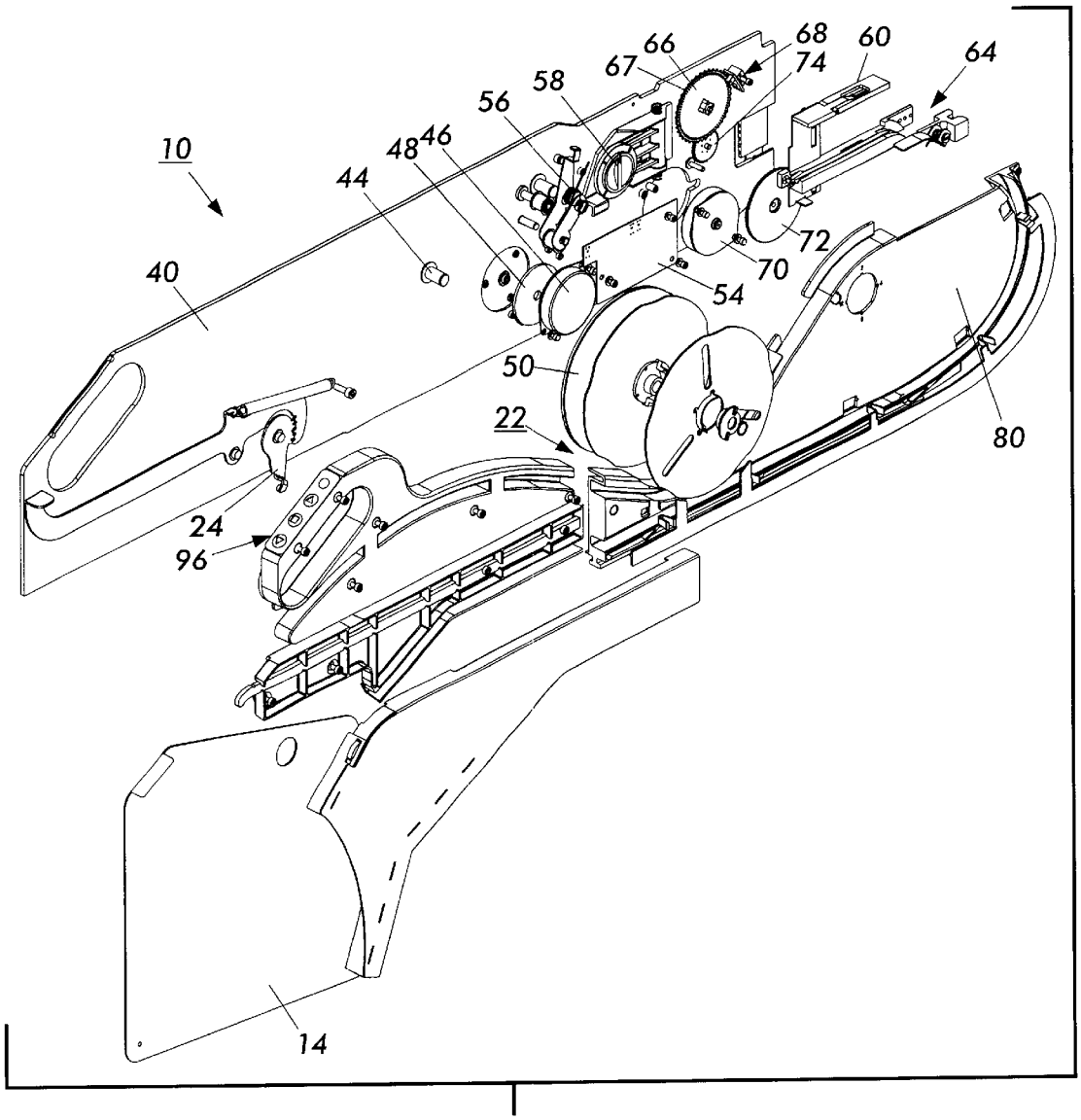
FIG. 2 is a detailed perspective view of the various components and assemblies of an embodiment in accordance with the present invention.

Referring next to FIG. 2, displayed therein is an assembly drawing depicting the various components in an embodiment of the multi-pitch feeder 10. Feeder 10 is assembled upon a rigid metal base plate 40 that includes a mounting surface for latch assembly 24. Extending from base plate 40 is a post 44 to which the split-hub take-up reel 22 is mounted. As will be further described, take-up reel 24 is driven by a stepper drive motor 46, driving a gear or pulley 48 that is directly coupled with take-up reel drive gear or pulley 50. It will be appreciated that alternative drive mechanisms may be employed for the take-up reel, however, as will be described below a direct drive system is preferred for certain aspects of the present invention.

Figure 3:
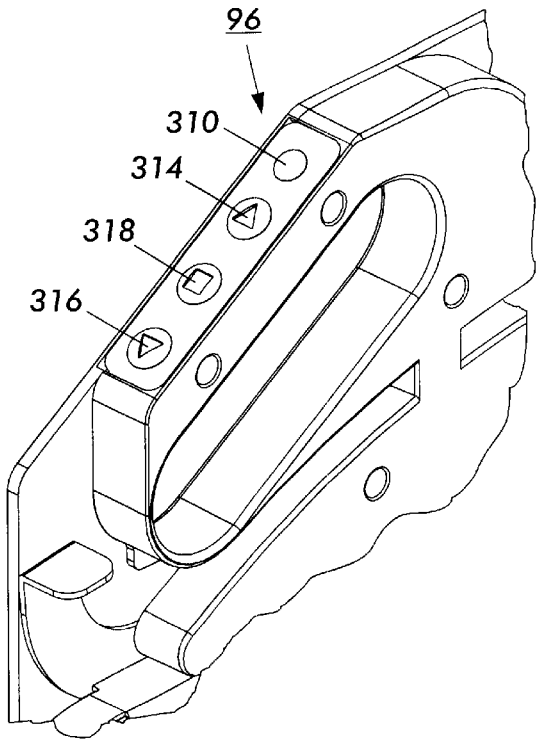
FIG. 3 is a perspective view of an exemplary handle for a tape feeder.

Feeder control hardware and software is present on board 54, which is operatively associated with peel arm assembly 56 and cammed selection knob 58 via optical sensors as will be described below. Cammed selection knob 58 also slidably adjusts a tape window 60 relative to a front locator assembly 64. Front locator assembly 64 also serves to hold carrier tape in position with respect to toothed drive sprocket 66. Sprocket 66 is preferably a sprocket having teeth set apart at a distance corresponding to the 4 mm pitch of the feed holes or a similar drive mechanism for engaging feed-holes regularly spaced along the length of carrier tape. In one embodiment, sprocket 66 is directly advanced or reversed under the control of stepper drive motor 70 and gears 72 and 74. While the position of the sprocket may be controlled via the stepper motor, operation or position of the sprocket is preferably monitored via sensor 68, which is positioned so as to sense an optically encoded ring 67 (equivalent to a 2 mm pitch) about sprocket 66 that is further illustrate in FIG. 2. Referring briefly to FIG. 3, the handle 96 includes a status light 310 that indicates the following status:

| Status | Indication |
|---|---|
| Tape feed error or jam | flashing red |
| Feeder On | green/orange |
| Feeder Off | no light |
| Take-up Reel Almost Full | flashing amber |
| Take-up Reel Full | amber |

Handle 96 also includes a forward feed button switch 314 that advances the carrier tape by a distance equal to the selected tape pitch. Similarly, reverse feed button switch 316 that retracts or reverses the carrier tape by a distance equal to the selected tape pitch. Lastly, single hole feed switch 318, when depressed in conjunction with switch 314 or 316 advances the carrier tape by a single drive pitch (e.g., 4 mm).

Figure 4:
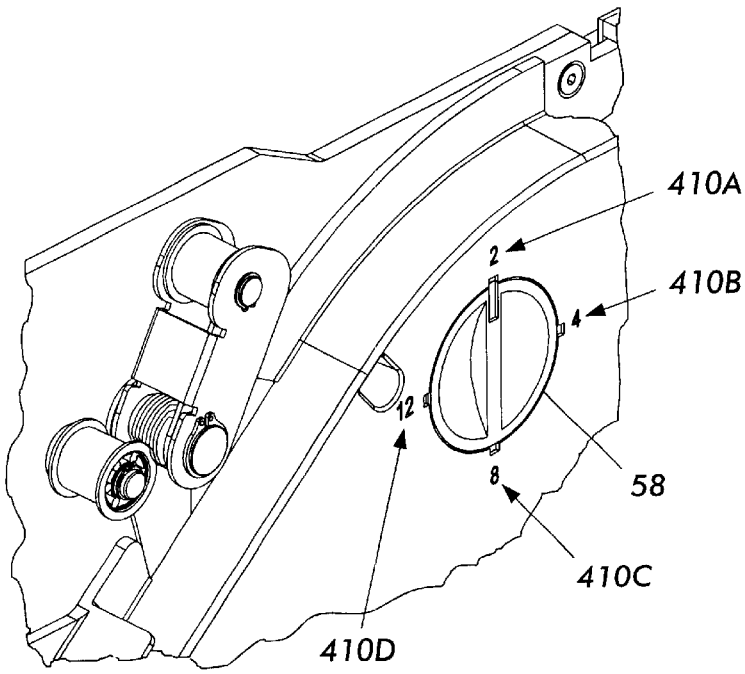
FIG. 4 depicts a perspective, enlarged view of the pitch selector knob in a component feeder in accordance with the present invention.
Figure 5:
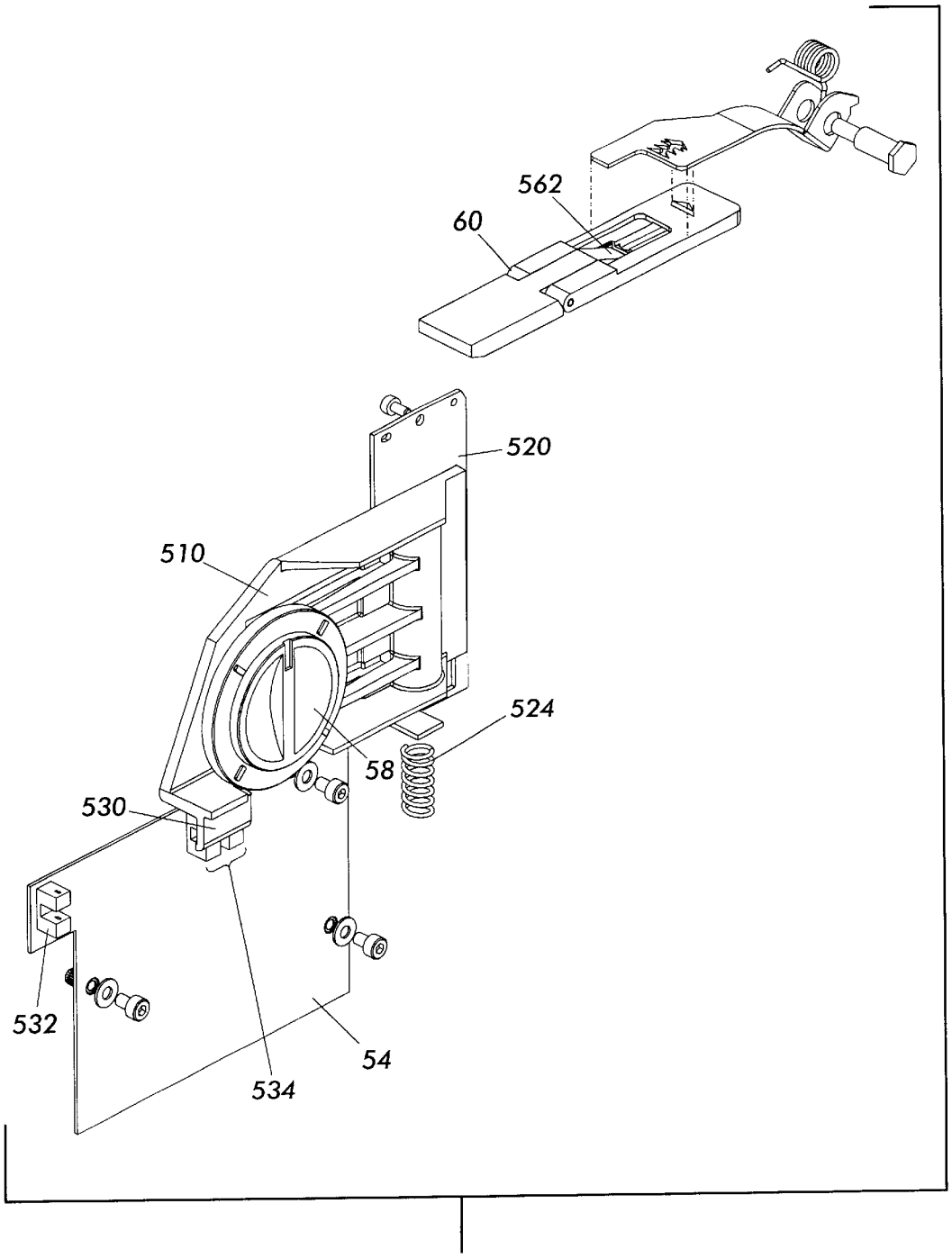
FIG. 5 is a detailed assembly view of the components of the pitch selection mechanism.
Figure 6:
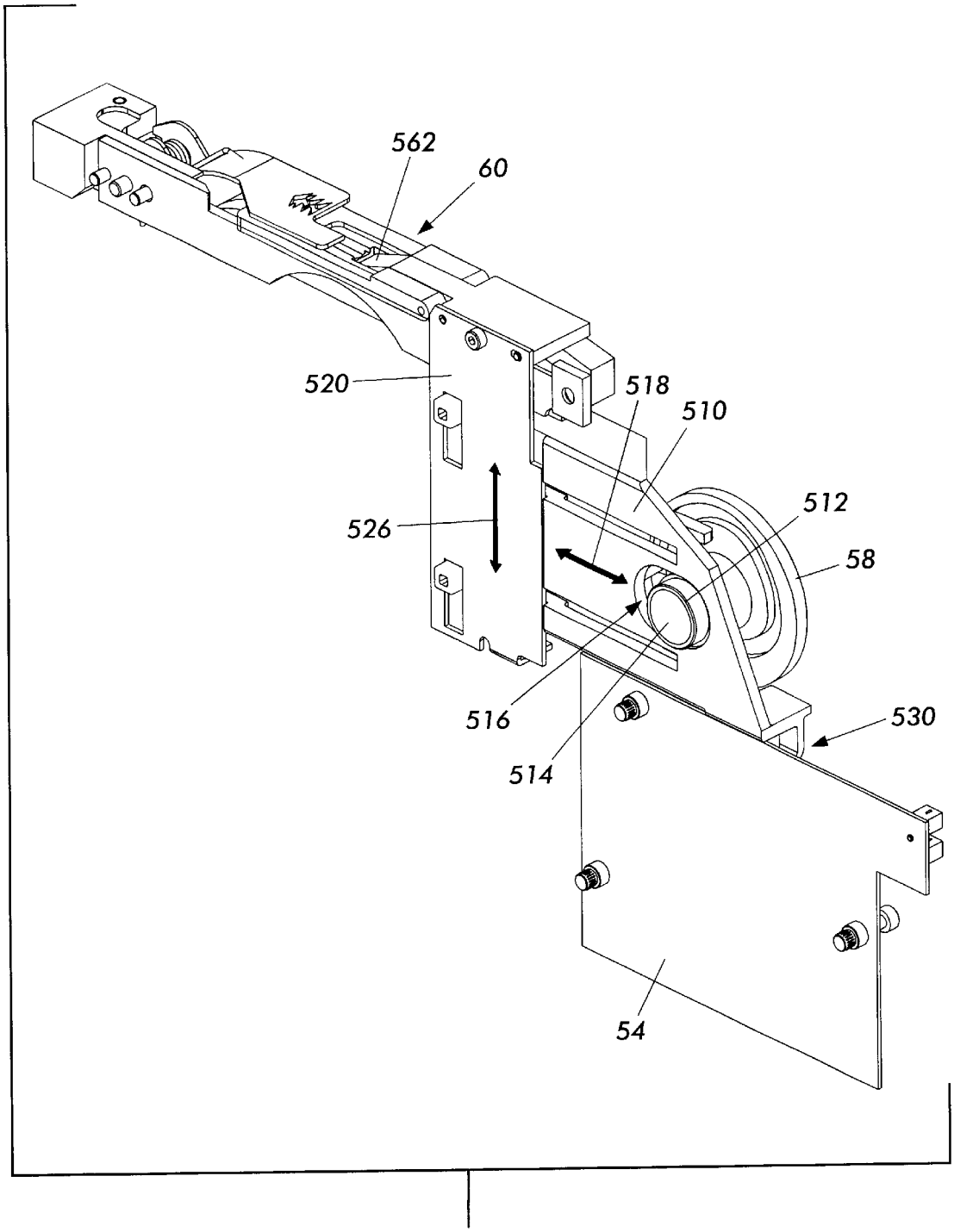
FIG. 6 is a rear perspective view of the assembled components of FIGS. 4 and 5.

Referring next to FIGS. 4–6, the operation of the cammed pitch selector knob will be described. As depicted in FIG. 4, pitch selector knob 58 may be rotated so as to be positioned in one of four pitch selection positions 410*a*–410*d*, respectively representing 2 mm, 4 mm, 8 mm and 12 mm pitch selections in the embodiment described herein. As further depicted in FIGS. 5 and 6, which respectively depict front and rear assembly views of the pitch selection means, knob 58 is operatively associated with a pitch plate 510 which has an elongated hole 516 cut therein. Through the hole passes the cammed shaft 512 of knob 58, wherein the cammed shaft is offset from the knob's center (represented by point 514). Thus rotating the knob into one of the four positions will cause the cammed shaft to pivot eccentrically about the axis at point 514.

Referring particularly to FIG. 6, as the cammed shaft rotates, it progressively interferes with the edge of hole 516, causing pitch plate 510 to move in the direction indicated by arrow 516. Tape window 60 is attached to pivot plate 510, via window cover slide 520, which in turn adjusts the location of tape window 60 when the selection knob is rotated. It will be appreciated that the rotation of the cammed shaft in hole 515 will also cause some vertical motion, and cover slide 520 uses a spring-loaded (spring 524) mechanism and slides in the direction of arrows 526 to prevent the vertical displacement from being imparted to the tape cover window.

As further depicted in FIGS. 5 and 6, pitch plate 510 includes a tab or flag 530 that is disposed in proximity to control board 54, where the position of the flag may be sensed by one or both of a pair of transmissive optical sensors 534. As will be appreciated, the various states of the pair of optical sensors (flag present or not present) may be used to identify the four positions of selector knob 58 and the associated location of tape window 60. Accordingly, the signals from the optical sensors 534 are employed by the controller to determine the selected pitch and are subsequently used to control the carrier tape advancement via stepper drive motor 70 and the optical encoding of sprocket 66 in a conventional fashion.

Figure 7:
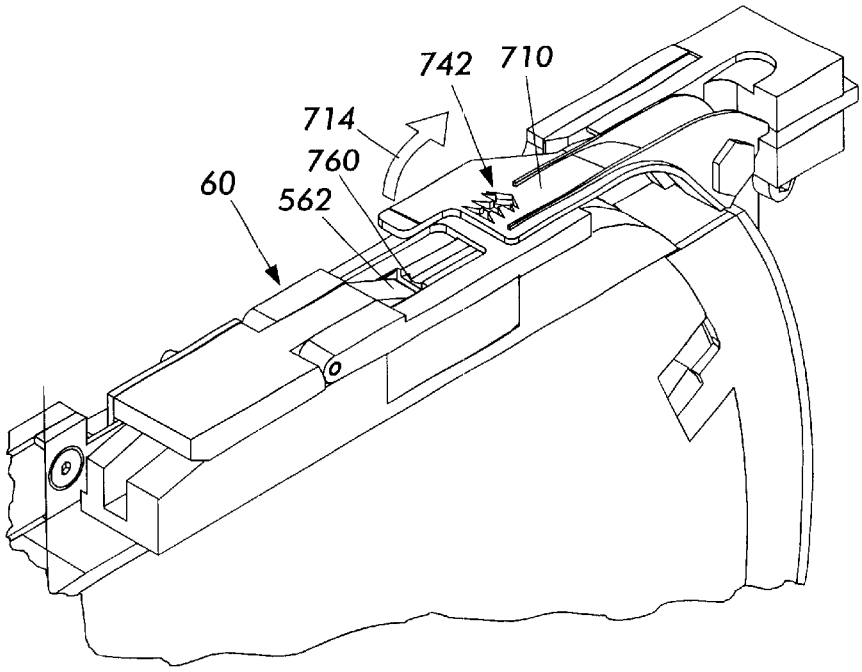
FIGS. 7 and 8 are detailed perspective views of the pick location of FIG. 1, showing the window latch in closed and open positions, respectively.
Figure 8:
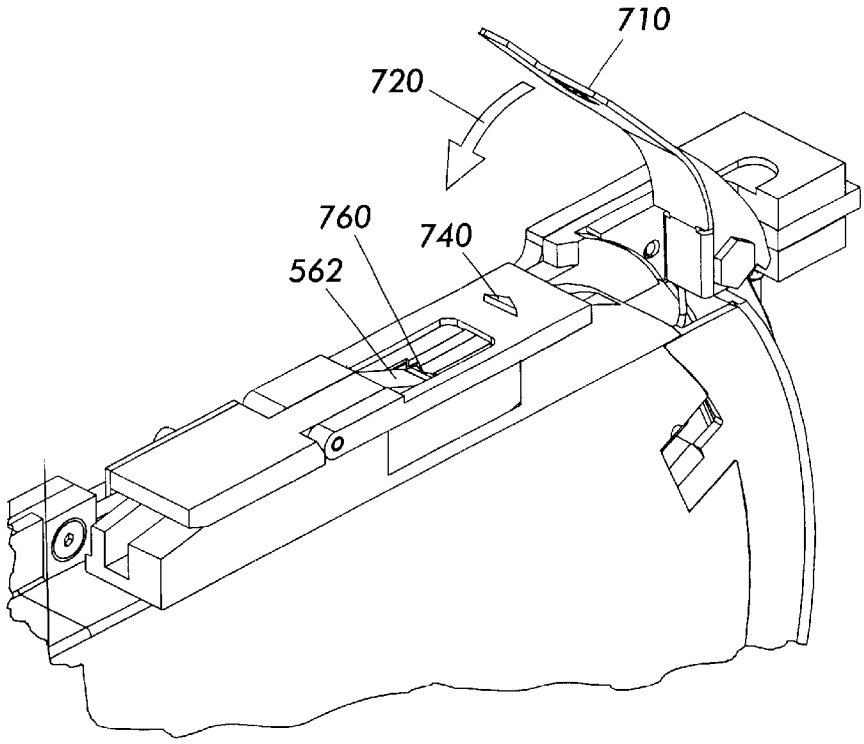
Figure 9:
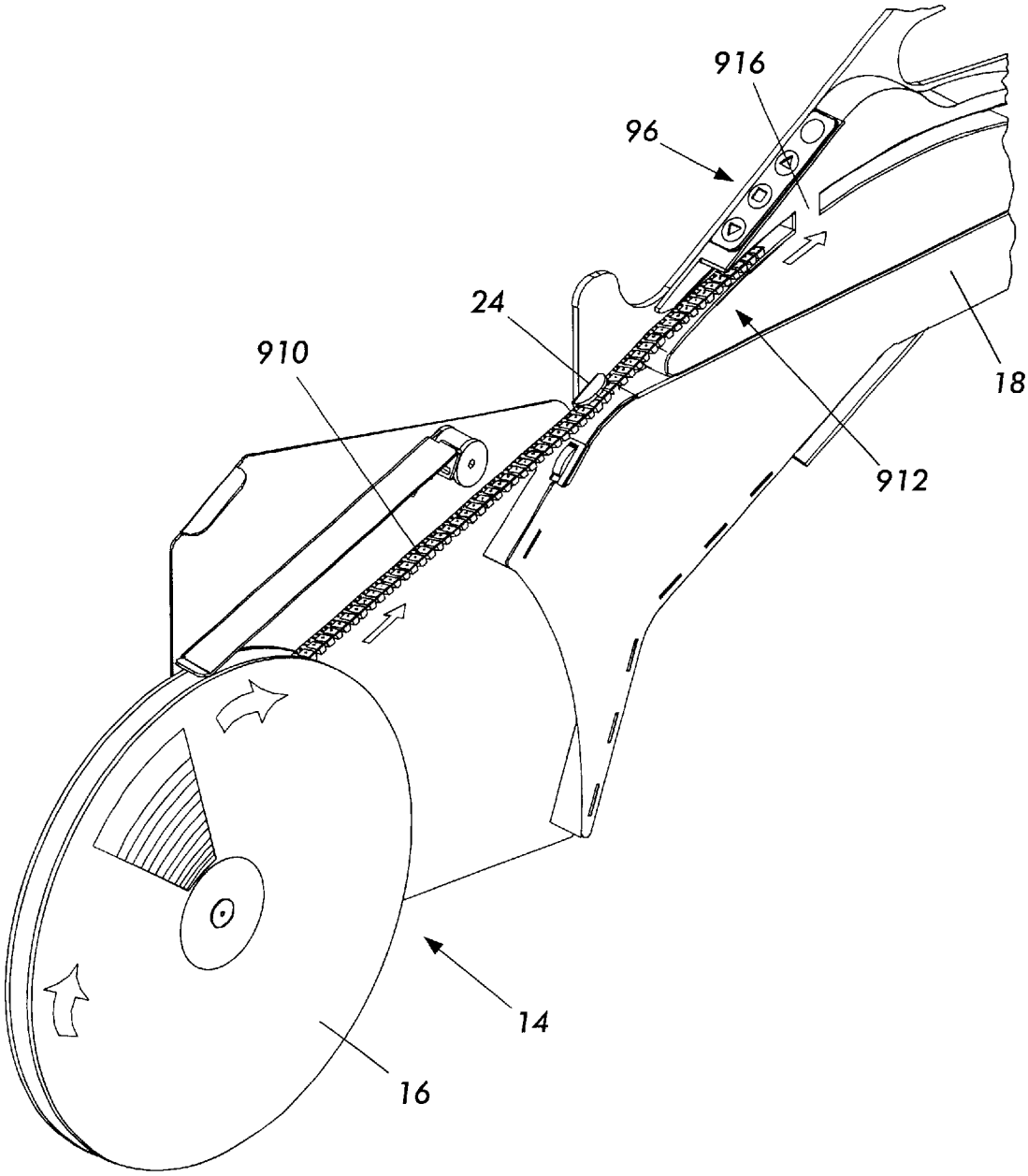
FIG. 9 is a detailed perspective view illustrating the component tape reel and tape path at the tail of the feeder of FIG. 1.

Having described the various components of the multi-pitch selection mechanism, attention is now turned to FIGS. 4, 7 and 8, where the method of setting the pitch will be briefly described along with the pitch selection mechanism. Before installing a carrier tape or using the multi-pitch feeder, the appropriate pitch must be selected. Referring to FIG. 7, once the tape pitch has been identified, the window latch 710 is released and moved upward in the direction indicated by arrow 714.

Once the window latch is clear of the tape window 60, the cammed knot 58 (e.g., FIG. 4) may be rotated to select the desired pitch. As described above, the tape window will then move to the desired position. Movement of the tape window 60 also results in the movement of the cover tape peel edge 562 as depicted in FIGS. 5–8. In other words, the cover tape peel edge adjusts with the tape window so that even though the pitch is changed, there peel edge advances and retracts so that the components remain covered by the cover tape and peel edge until they reach the pick location. Hence, the movement of the peel edge 562 minimizes the exposure of the uncovered component to dislocation or disengagement from the carder tape depressions.

Once window 60 is positioned, the window latch 710 may be returned to a locking position as indicted by arrow 720 in FIG. 8. As illustrated in FIGS. 7 and 8, because the tape window is slidable, it must be locked into position during operation. Locking is accomplished in the illustrated embodiment using a triangular-shaped protrusion 740 on the surface of the tape window that positively intersects with one of a plurality of adjacent or intersecting, like-shaped, cutouts 742 in the window lock. It will be further appreciated that alternative locking mechanisms may be employed.

As is depicted in FIGS. 7 and 8, a gate 760 is positioned slightly ahead of the peel edge 562, Gate 760 is intended to prevent components that are electrostatically attracted to the cover tape from being removed from the pockets when the cover tape is peeled about edge 562. Gate 760 is preferably flat on the side facing the peel edge, and may include an oval or alternatively shaped pick-location side so as to minimize the likelihood of interference with the head of the pick and place assembly system during component retrieval.

Referring next to FIGS. 9–13, there will be described the method of loading or threading a carrier tape in the system, as well as the operation of the various components of the multi-pitch feeder in accordance with the present invention. Initially, and possibly with the with carrier tape reel support 14 extended, a carrier tape reel is attached to the reel support in a manner such that tape 910 feeds from the reel from the top and where the reel feeds in a clockwise direction as indicated by the arrows. Tape 910 is then threaded below the latch handle 24 and into the upper tape path or guide 912 where it is retained within the open upper tape path by a plurality of vertical members 916.

Figure 10:
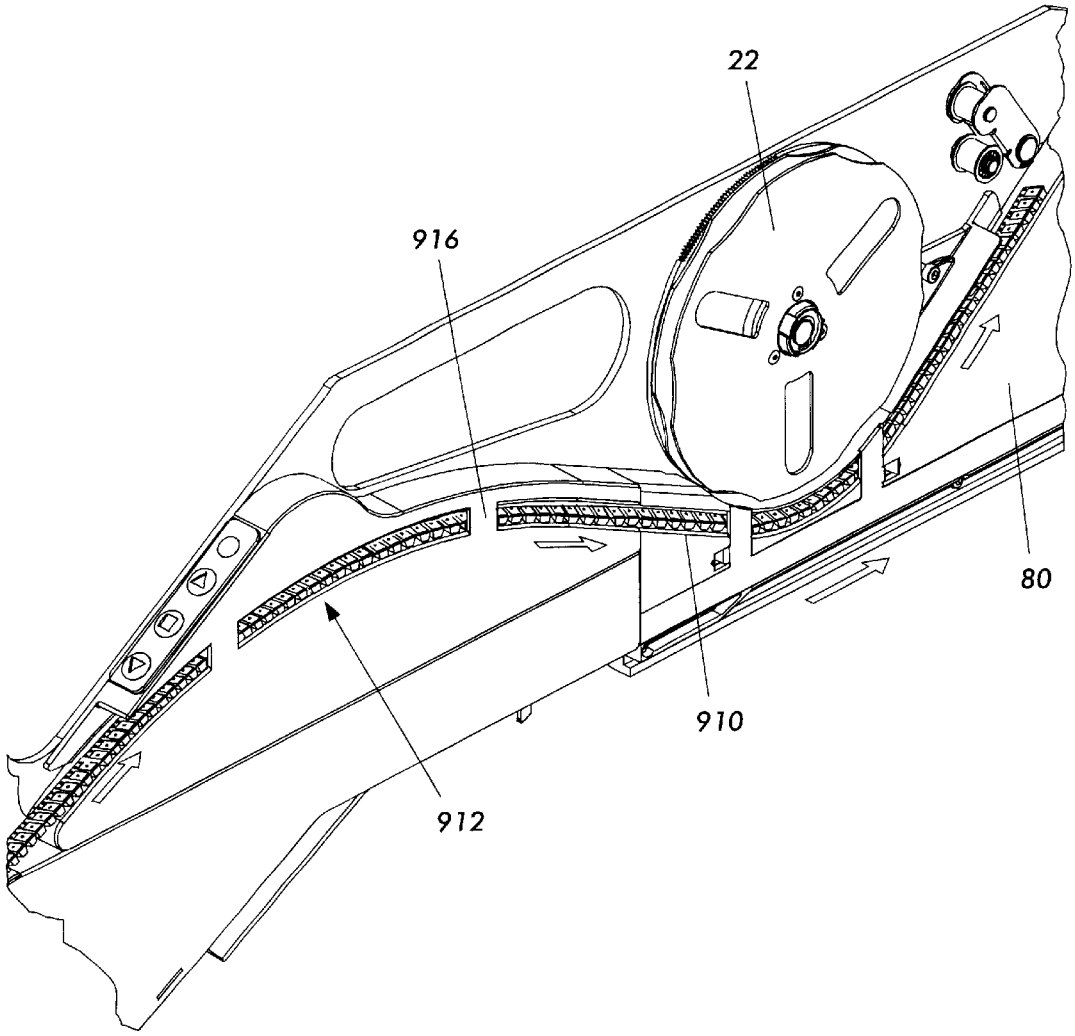
FIG. 10 is a detailed view of the tape path in the feeder of FIGS. 1 and 2 up to the take-up reel.
Figure 11:
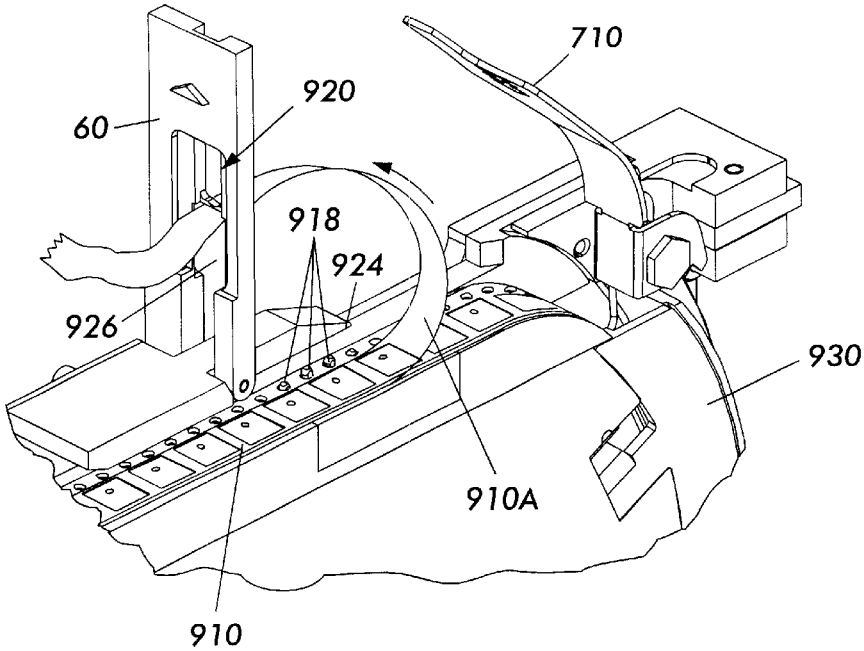
FIG. 11 is an illustration of the feeding of cover tape though the peel edge in accordance with the present invention.

As further depicted in FIG. 10, carrier tape 910 is continuously fed through the upper tape path 912 in the feeder front cover 80. In a direction toward the tape window and pick location as indicated by the arrows. At the tape window, the carrier tape is engaged with the teeth 918 of the drive sprocket. When the carrier tape reaches the pick location 920 defined within tape window 60, the window latch 710 is released and the cover tape 910*a* is peeled back from the carder tape 910 for a least a length thereof. As depicted in FIG. 11, when the cover tape is peeled back, it is preferably directed over the peel edge 924 and back through an opening 926 in the tape window. The peeling of the cover tape is subsequently accomplished at the peel edge as the carrier tape is advanced as is well known in various tape feeders.

Figure 12:
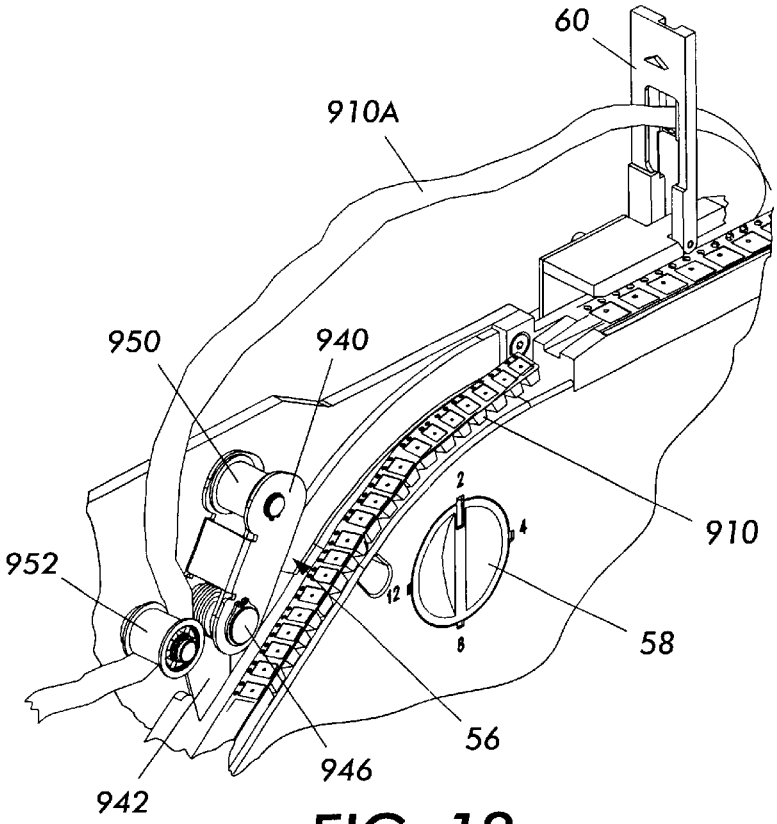
FIG. 12 Illustrates the threading path of the cover tape subsequent to the region illustrated in FIG. 11.

As carrier tape 910 is further advanced, it is directed into the exit or discharge chute or path 930 that, as previously described, extends along the lower perimeter of the front cover. Referring next to FIG. 12, the cover tape is then further fed through peel arm assembly 56, which preferably includes a bracket 940 having an arm or flag 942 extending therefrom. Bracket 940 is designed to pivot, under spring tension, about point 946, so that pulleys or wheels 950 and 952 remain in contact with the cover tape and maintain tension thereon as the carrier tape is advanced past the peel edge. Flag 942 serves to interrupt or trigger optical sensor 532 (shown in FIG. 5) as the peel arm assembly is pivoted, and is employed in the estimation of the state of fill of take-up reel 22 as will be further described below.

Figure 13:
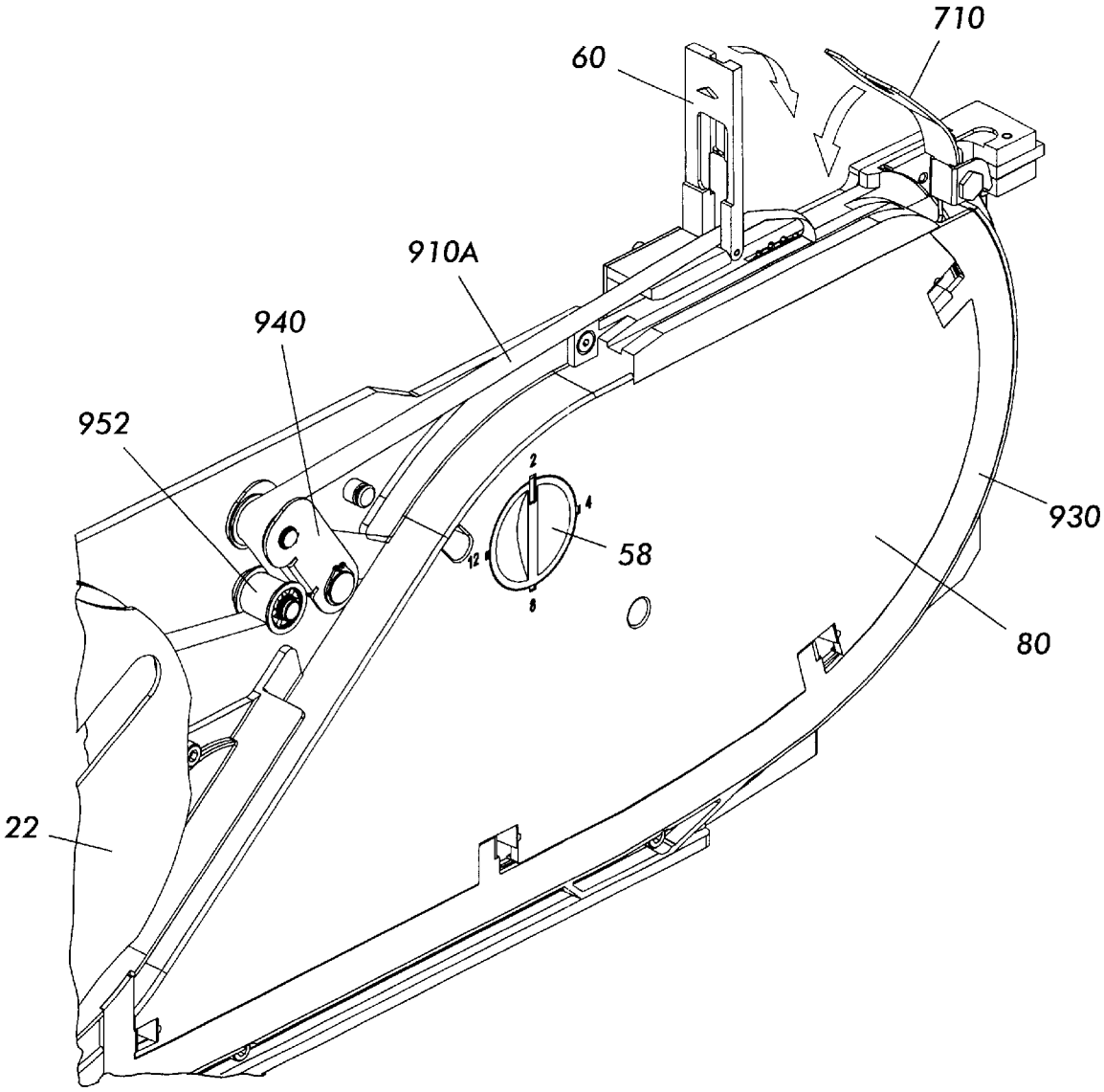
FIG. 13 illustrates the assembled feeder and the cover tape path in accordance with aspects of the present invention.

Referring also to FIG. 13, once the cover tape 910*a* is threaded through the peel arm assembly, it is passed through an outer hub of the take-up reel 22 and affixed thereto by cinching it between the inner and outer hubs. The take-up reel is then installed on its drive hub (not shown) and the cover tape is manually tightened as the cover tape window 60 and latch 710 are returned to their operating positions as indicated by the arrows in FIG. 13.

Lastly, as depicted in FIG. 2, take-up reel 22 is preferably of a split and tapered-hub design (as more particularly described in the co-pending application referenced above), so as to provide a significant advantage when it is necessary to remove the cover tape therefrom. In particular, the cover tape having been tightly wound on the take-up reel is typically removed by unwinding the reel in a separate manual or automated process. However, the split hub allows the reel to be disassembled once removed from the feeder. Furthermore, the tapered surfaces allow the center of the wound cover tape to collapse once the assemblies are separated, thereby facilitating removal from the hub without unwinding or cutting the tape therefrom.

In recapitulation, the present invention is multiple-pitch tape feeder, including a slidable tape window and cover tape peel edge for exposing a component only at a pick location adjacent a peel edge. The feeder also includes a pitch selection cam having a plurality of positions, each corresponding to one of a plurality of carrier tape pitch sizes, wherein movement of said selection cam is directly translated into movement of the tape guide. A sensor is employed for detecting the position of the selection cam, and a control unit, responsive to the sensor, controls the carrier tape driver thereby advancing the carrier tape a predetermined distance according to the selected pitch size.

It is, therefore, apparent that there has been provided, in accordance with the present invention, a method and apparatus for reliably conveying component parts to a pickup location using a carrier tape. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A multiple-pitch tape feeder, comprising:

a carrier tape reel support for supporting carrier tape having any one of several predetermined pitches and a cover tape retaining components therein;

a slidable tape guide with a tape window therein for exposing a component at a pick location adjacent a cover tape peel edge for peeling said cover tape from the carrier tape;

a path for guiding said carrier tape from a carrier tape reel to the slidable tape guide;

a carrier tape drive mechanism for engaging feed-holes regularly spaced along the length of carrier tape and advancing said carrier tape through said tape guide;

a pitch selection cam repositionable by an operator, said selection cam having a plurality of positions, each corresponding to one of a plurality of predetermined pitch sizes, wherein movement of said selection cam is directly translated into movement of said slidable tape guide;

a sensor detecting a position of the slidable tape guide; and a control unit, responsive to said sensors for providing a signal to said carrier tape drive mechanism, said carrier tape drive mechanism advancing the carrier tape a predetermined distance according to the pitch size.

2. The feeder of claim 1, wherein said carrier tape reel support is extendible along a longitudinal axis of the feeder so as to provide access to the support during continued operation of the feeder.

3. The feeder of claim 1, wherein said slidable tape guide further includes means for locking said slidable tape guide into the corresponding pitch position.

4. The feeder of claim 3, wherein said slidable tape guide further includes a gate spaced apart from the peel edge wherein the gate prevents components from remaining attached to the cover tape as it is peeled from the carrier tape.

5. The feeder of claim 1, wherein said slidable tape guide further includes a cover tape peel edge, and where the cover tape peel edge slides in association with said slidable tape guide so as to reveal a component at the pick location adjacent the cover tape peel edge.

6. The feeder of claim 1, wherein said carrier tape drive mechanism comprises:

a sprocket having teeth set apart at a distance corresponding to the pitch of feed holes on the carrier tape; and a motor, operatively coupled to said sprocket, for advancing and reversing the carrier tape past said slidable tape guide.

7. The feeder of claim 6, wherein said sprocket includes an optically encoded ring adjacent a perimeter thereof, and where said carrier tape drive mechanism further comprises an optical sensor for monitoring the optically encoded ring and feeding the position of the sprocket back to the control unit for control of the carrier tape drive mechanism.

8. The feeder of claim 1, wherein said pitch selection cam is rotatable into one of the plurality of positions, and where each of said positions corresponds with a predetermined carrier tape pitch, said feeder further comprising:

a pitch plate having an elongated hole therein through which said pitch selection cam extends; and a pivot plate, connected between said pitch plate and said slidable tape guide, so as to adjust the location of said slidable tape guide when the pitch selection cam is rotated.

9. The feeder of claim 8, wherein the rotation of the pitch selection cam causes vertical motion, and where said pivot plate is interconnected to the pitch plate with a spring-loaded slide to essentially eliminate any vertical displacement from said pitch selection cam being Imparted to said slidable tape guide.

* * * * *